US007052054B2

(12) United States Patent
Luker

(10) Patent No.: US 7,052,054 B2
(45) Date of Patent: May 30, 2006

(54) ELECTRIC DROP BOLT WITH SLIDABLE DRIVE MECHANISM

(76) Inventor: Graham James Luker, 21/21-25 Bourke Street, Cronulla (AU) 2230

( * ) Notice: Subject to any disclaimer, the term of this patent is extended or adjusted under 35 U.S.C. 154(b) by 30 days.

(21) Appl. No.: 10/819,590

(22) Filed: Apr. 7, 2004

(65) Prior Publication Data

US 2004/0207210 A1 Oct. 21, 2004

(30) Foreign Application Priority Data

Apr. 15, 2003 (AU) ..... 2003901782

(51) Int. Cl.
*E05C 3/06* (2006.01)

(52) U.S. Cl. ..... 292/201; 292/199

(58) Field of Classification Search ..... 292/201, 292/144, DIG. 21, 199; 70/279.1
See application file for complete search history.

(56) References Cited

U.S. PATENT DOCUMENTS 1,247,052 A * 11/1917 Wilson ..... 292/5
5,197,771 A * 3/1993 Kaup et al. ..... 292/45
5,628,216 A * 5/1997 Qureshi et al. ..... 70/278.7
6,386,600 B1 * 5/2002 Kalsi ..... 292/216
2004/0098915 A1 * 5/2004 Baldry ..... 49/339

* cited by examiner

*Primary Examiner*—Gary Estremsky
(74) *Attorney, Agent, or Firm*—Jacobson and Johnson

(57) ABSTRACT

There is an electric motor driven drop bolt having a housing which in use is mounted into a doorway frame and has the bolt pivotal therein by a mechanical drive set in a cage disposed at an operative position. The bolt is pivotal between a locking configuration where the bolt extends outward of the housing to engage in an aperture associated with a door within the frame and an unlocked configuration where the bolt is withdrawn to clear the aperture. The mechanical drive includes a screw shaft rotatable by the electric motor to move a roller nut along the length of the shaft whilst engaging a cam surface on the bolt. To obtain fail safe operation of the drop bolt the cage is slidable in the housing from the operative position to a disengaged position so that the bolt is movable from the locking configuration to the unlocked configuration without operation of the mechanical drive.

9 Claims, 2 Drawing Sheets

ELECTRIC DROP BOLT WITH SLIDABLE DRIVE MECHANISM

FIELD OF THE INVENTION

This invention relates to security locks. More particularly, although not exclusively, it discloses an improved electric motor driven drop bolt comprising user selectable power-to-open or power-to-lock conversion.

BACKGROUND OF THE INVENTION

The purpose of a drop bolt is to provide a concealed lock for a door or a movable barrier. In prior art devices a solenoid moves a bolt axially out from the doorway frame and into a strike plate set in the edge of the door. The strike plate has an aperture dimensioned to axially receive the bolt so that once it is in place the door is effectively locked. Such devices are generally used where security is desired as well as concealment of the installation when the door is locked.

There are however a number of problems with the devices currently in use. If there is any misalignment of the door in the frame the bolt will hit the strike plate rather than seat in the hole. While with some systems the bolt will pulse for a limited time the door will still only lock if the strike plate hole is precisely aligned with the bolt. There are also further problems associated with releasing a locked door. For example the lock can jam if any side loads are imposed from air pressure differentials, persons pressing against the door or door warpage etc. In such cases the bolt becomes jammed in the hole and cannot be withdrawn by the relatively weak pull of the solenoid. The power required by a solenoid system to slide the axially moving bolt into and out of the locking aperture even during normal unhindered operation is also excessive. While the applicant's co-pending Australian patent application 66599/00 discloses a more direct and power efficient drive for such locks comprising a screw shaft rotatable by an electric motor to move a roller nut along said shaft and engage a cam surface on a pivotal bolt this mechanism still has disadvantages. In order to provide for fail safe operation the bolt is spring biased to the withdrawn position and the drive mechanism is mounted in a cage which is also pivoted in the lock housing to disengage the nut from the cam surface. Such arrangement requires excessive depth in the housing to accommodate the pivoting movement of the cage. Also, during disengagement of the roller nut from the bolt there is a possibility of the drive mechanism becoming unsynchronized and jamming.

SUMMARY OF THE INVENTION

It is therefore an object of this invention to ameliorate the aforementioned disadvantages and accordingly a drop bolt which includes a user selectable power-to-open and power-to-lock conversion is disclosed for securing a door or other movable barrier, the drop bolt having a housing which in use can be mounted into a frame for said door or other movable barrier and said housing having a bolt which is pivotal therein by an electric motor powered mechanical drive when set in a cage at an operative position, the bolt being pivotal between a locking configuration where the bolt can extend outward of said housing for engagement in an aperture associated with said door or other movable barrier and an unlocked configuration where the bolt is withdrawn clear of said aperture, said mechanical drive including a screw shaft rotatable by an electric motor to move a roller nut along the length thereof whilst engaging a cam surface on said bolt and said cage being slidable in the housing from said operative position to a disengaged position whereby the bolt is movable from said locking configuration to said unlocked configuration to obtain fail safe operation of the lock without operation of said mechanical drive.

Preferably the housing includes a face plate which in use of the lock is set into the surface of the doorway frame with said cage being located behind said face plate and slidable in a direction substantially parallel thereto.

It is further preferred that during fail safe operation of the lock the roller nut remains engaged with said cam surface.

It is further preferred that the bolt includes a roller to facilitate engagement in said aperture.

It is further preferred that the aperture comprise a tapered slot in a strike plate set into an edge of said door.

BRIEF DESCRIPTION OF THE DRAWINGS

The currently preferred form of this invention will now be described with reference to the attached drawings in which:—

DETAILED DESCRIPTION OF THE PREFERRED EMBODIMENT

Figure 1:
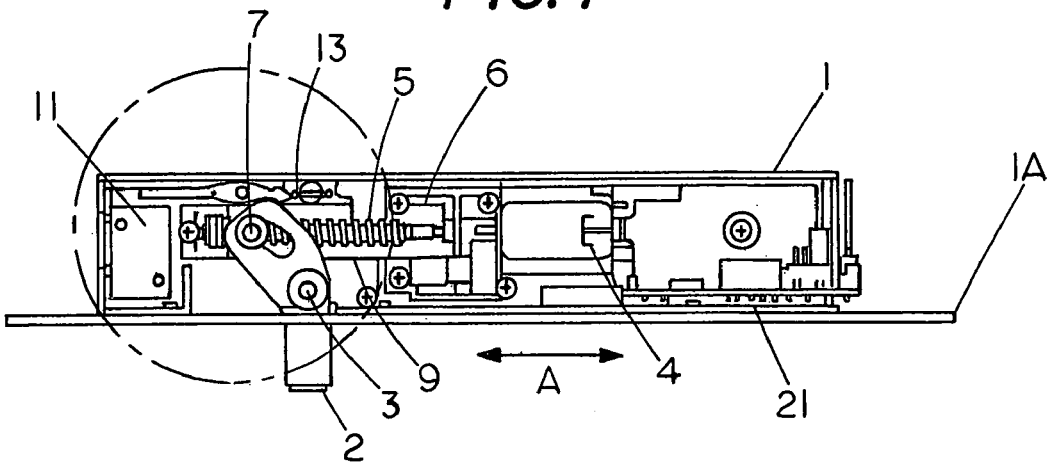
FIG. 1 is a cross-sectional side view of the lock when in the latched configuration.

Referring first to FIG. 1 there is shown an electric lock comprising a housing 1 which is adapted for mounting into a doorway frame with face plate 1A facing outward. The housing has a bolt 2 pivoted about a pin 3 so that it can move between the locking configuration shown in FIG. 1 where it extends out from the frame and an unlocked configuration where it is substantially within the housing. The mechanical drive assembly for the bolt comprises an electric motor 4 which turns a screw shaft 5 through reduction gears 6. Mounted on the screw shaft 5 is a roller nut 7 which moves along the length of this shaft as said shaft is rotated by the motor. The roller nut 7 in turn engages a closed cam surface 8 formed as part of the bolt 2. When the mechanical drive assembly is in the normal operative position shown in FIG. 1 the roller nut, in accordance with the direction of motor rotation, moves either to the left end of the screw shaft 5 as shown in FIG. 1 or to the right end (not shown) in order to perform the normal functions of locking and unlocking the door.

Figure 2:
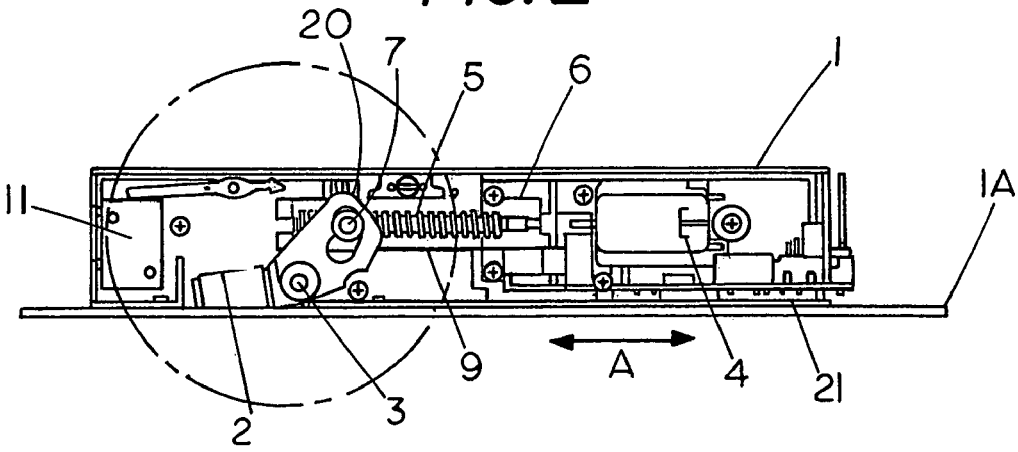
FIG. 2 is a view similar to FIG. 1 but with the lock in the unlatched configuration.
Figure 1A:
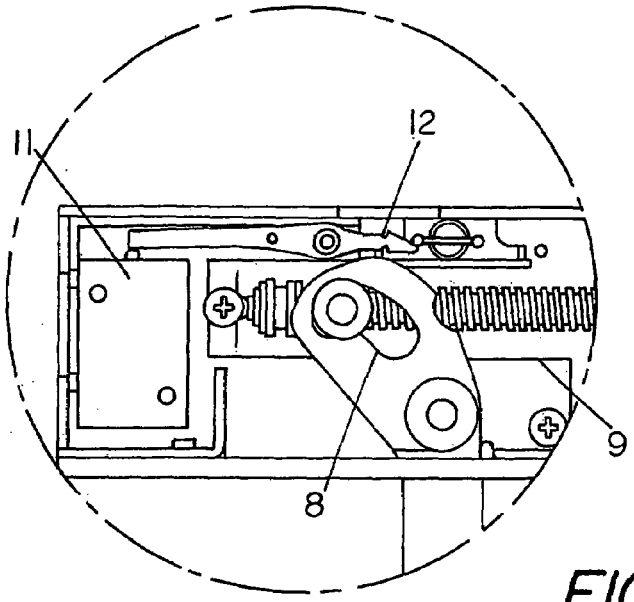
FIG. 1A is a detailed view of part of the lock shown in FIG. 1.
Figure 2A:
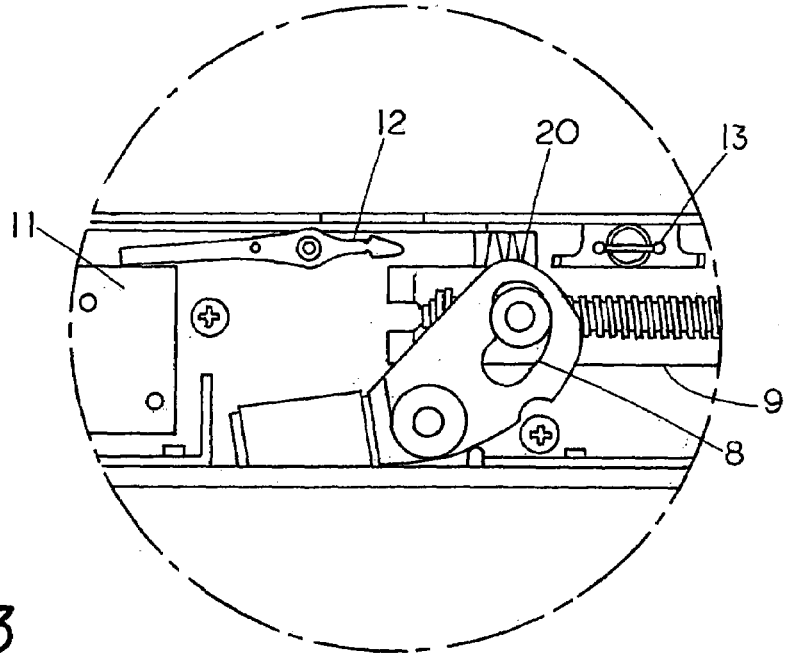
FIG. 2A is a detailed view of part of the lock shown in FIG. 2.

In order to provide for Fail Safe operation the drive assembly is mounted in a cage 9 which is slidable to the right within the housing 1 from said operative position shown in FIG. 1 to the disengaged position shown in FIG. 2. Preferably the cage 9 and drive assembly slides along a direction parallel to the face plate as indicated by arrow A. A solenoid 11 is also fitted inside the housing at a location as shown in detail by FIGS. 1A and 2A. When energised it operates a latch lever 12 which retains the cage 9 at the operative position shown in FIG. 1. With the lock engaged only minimal power is required for the solenoid 11 to retain the cage in this position. To obtain the Fail Safe function power is removed from the solenoid 11. This releases the cage 9 together with the shaft 5 and roller nut 7 (ie. the mechanical drive assembly) to slide under the bias of spring 20 to the disengaged position shown in FIGS. 2 and 2A and thereby pivot the bolt 2 to the unlocked configuration without operation of the mechanical drive assembly.

There is also a latching plate 13 which can be rotated by 180 degrees from the position shown to retain the cage 9 at the operative position in the absence of solenoid power but release said cage when the solenoid is energised. This allows the lock to operate in a Fail Safe mode while still retaining an emergency function which releases the cage 9 when the solenoid 11 is pulsed from an external battery. Such emergency opening function is absent from prior art solenoid operated drop bolts.

Figure 3:
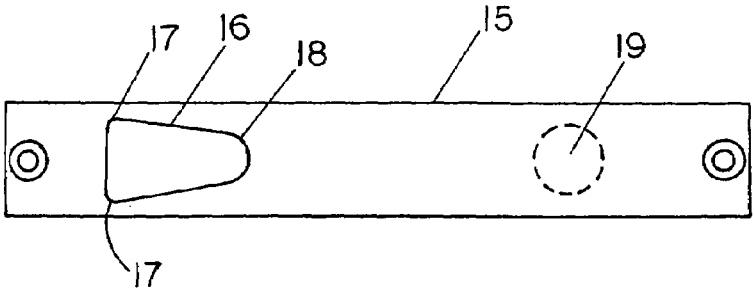
FIG. 3 is a plan view of the preferred form of door strike plate for use with the lock of FIGS. 1 and 2

To further enhance the locking mechanism the bolt 2 as mentioned earlier is preferably fitted with a roller 14 and the door strike 15 (shown in FIG. 3) is formed with a tapered slot 16. This allows the bolt 2 to enter the aperture at the widest point 17 and then roll to the narrow locking end 18. Door location is therefore less critical than with prior art drop bolt mechanisms as the action of the roller bolt within the slot aligns the door to the correct position. The roller and shape of the slot further facilitates withdrawal of the bolt when the door is under load.

It is also preferred that the strike plate 15 has a concealed magnet 19 located adjacent the activation point of a reed or hall effect switch 21 whereby said switch is activated as the door is closed. This switches on the motor 4 and the drive system to rotate the bolt to the locked position.

With this embodiment there is also a sensing bar (not shown) which moves with the roller nut 7 to limit the travel of said drive locking assembly in both directions.

Preferably there are electronics for the lock for sensing the position of the bolt 2 so that the unlocked and locked configurations can be controlled by an access control system.

It will thus be appreciated that this invention at least in the form of the embodiment disclosed provides a novel and useful improvement to drop bolt locks. The benefits over prior art mechanisms include the following:

- the interaction of the tapered face plate aperture and pivoting roller bolt assists in locating the door to the locking position,
- the operating mechanism requires less current than solenoid operated reciprocating bolt systems while still producing greater driving force on the bolt due to the use of reduction gears and screw shaft,
- there is an emergency release available in the Power-to-Open or Power-to-Lock mode,
- the bolt will not stick or jam due to dirt in the aperture or side pressure on the door,
- provision can be made for monitoring the bolt position and door status, and the lock is suitable for narrow style doors.

It is to be understood however that the example described is only the currently preferred form of the invention and a wide variety of modifications may be made which would be apparent to a person skilled in the art. For example the shape and configuration of the housing, pivoting bolt and strike plate as well as the arrangement of the mechanical drive can be changed according to application or design preference.

The invention claimed is:

1. A drop bolt for securing a door or other movable barrier, said drop bolt having a housing which in use can be mounted into a frame for said door or other movable barrier and said housing having a bolt which is pivotal therein by an electric motor powered mechanical drive when set in a cage at an operative position, the bolt being pivotal between a locking configuration where the bolt can extend outward of said housing for engagement in an aperture associated with said door or other movable barrier and an unlocked configuration where the bolt is withdrawn clear of said aperture, said mechanical drive including a screw shaft rotatable by the electric motor to move a roller nut along the length thereof whilst engaging a cam surface on said bolt and to obtain fail safe operation of said drop bolt the cage being slidable in the housing from said operative position to a disengaged position whereby the bolt is movable from said locking configuration to said unlocked configuration without operation of said mechanical drive.

2. The electric motor driven drop bolt as claimed in claim 1 wherein the cage is slidable in a direction substantially parallel to a face plate of said housing.

3. The electric motor driven drop bolt as claimed in claim 1 wherein the screw shaft is rotatable by the electric motor through reduction gears.

4. The electric motor driven drop bolt as claimed in claim 1 wherein a solenoid is fitted inside the housing which when energised retains the cage at said operative position and when de-energised releases said cage to slide to said disengaged position under a spring bias.

5. The electric motor driven drop bolt as claimed in claim 3 wherein the housing further includes a latching plate which can be rotated to an engaged setting which retains the cage at the operative position in the absence of power to said solenoid but releases said cage to slide to said disengaged position when said solenoid is energised.

6. The electric motor driven drop bolt as claimed in claim 1 wherein said shaft is fitted with a roller and said aperture is in the form of a tapered slot and is arranged such that the bolt can enter the aperture at the widest point thereof and then roll to a narrower locking end while simultaneously aligning said door to a correct locking position in said doorway frame.

7. The electric motor driven drop bolt as claimed in claim 1 wherein said aperture is formed in a strike plate located in the door, said strike plate having a concealed magnet which when the door is closed is located adjacent an activation point for a reed switch in the housing, said reed switch thereby initiating the mechanical drive to lock the door.

8. The electric motor driven drop bolt as claimed in claim 1 wherein a sensing bar is fitted to the roller nut to limit the travel of said nut along the screw shaft.

9. The electric motor driven drop bolt as claimed in claim 1 wherein an electronic sensing means is provided to enable control of said bolt between the locking and unlocked configurations by an access control system.

* * * * *